United States Patent [19]

Delaplace et al.

[11] 3,942,945

[45] Mar. 9, 1976

[54] BURNER FOR THE DIRECT HEATING UP OF A FLUID BY ACTION OF THE COMBUSTION

[75] Inventors: Lucien Delaplace, Sevres; Jean-Claude Mevel, Sarcelles, both of France

[73] Assignee: Stein Industrie, Velizy Villacoublay, France

[22] Filed: Oct. 8, 1974

[21] Appl. No.: 513,169

[30] Foreign Application Priority Data

Oct. 11, 1973 France ..... 73.36347

[52] U.S. Cl. ..... 432/222; 431/285; 23/277 C

[51] Int. Cl.[2] ..... F24H 3/14

[58] Field of Search ..... 432/222, 223; 431/285, 431/284; 23/277 C

[56] References Cited

UNITED STATES PATENTS

| | | | |
|---|---|---|---|
| 3,251,656 | 5/1966 | Edwards | 23/277 C |
| 3,494,712 | 2/1970 | Vosper et al. | 432/223 |
| 3,632,286 | 1/1972 | Kegan et al. | 431/284 |
| 3,843,309 | 10/1974 | Lambiris | 431/284 |

*Primary Examiner*—Carroll B. Dority, Jr.

*Attorney, Agent, or Firm*—Waters, Schwartz & Nissen

[57] ABSTRACT

A burner for the direct heating of a fluid by the combustion of an assisted spray liquid and a gaseous substance. Above a grating are arranged spray nozzles for the spraying liquid and injectors for the gas. The said spray nozzles and injectors have independent and respective feed systems. They are arranged in space so as to enable the flowing of the fluid to be heated up, in such a way that the combustion produces a distributed giving off of heat insuring the homogenous heating up thereof in combination with convection means contributing to the stirring thereof. The burner is applicable, to steam generators, to the heating of premises and to the depollution of polluted smoke.

8 Claims, 9 Drawing Figures

BURNER FOR THE DIRECT HEATING UP OF A FLUID BY ACTION OF THE COMBUSTION

FIELD OF THE INVENTION

The present invention relates to a burner for the direct heating up of a fluid by the combustion of combustible fluids feeding it, and more particularly to a burner fed by an assisted spray liquid and a gaseous substance. The invention relates especially to a burner comprising, arranged above a grating, spray nozzles for the spraying fluid and injectors for the gas and relates as well to the arranging and spacing of the combustion means with a view to spreading out of heat according to a sheet of flames and to insuring the homogenous heating up of the fluid to be heated up.

BACKGROUND OF THE INVENTION

The direct heating up of a fluid which is already hot comes up against the difficulty of using, as a fuel, a liquid (e.g., of the fuel-oil type for feeding a burner whose ducts may be subjected to the temperature of the said fluid, which temperature may be in the order of a few hundreds of degrees and entail a danger of excessive vaporization or even of coking of the said liquid fuel. A known solution for overcoming the above noted difficulty consists of placing the combustible liquid feed pipe inside the said combustible gas duct and of feeding a mixed injector, that is, one which may operate either with gas or with a combustible liquid. This known solution has two great disadvantages: (1) on the one hand, the gas pipe on which the injectors are fixed is brought to a temperature which is clearly higher than the liquid pipe placed inside it, so that the coupling of the said liquid pipe to the corresponding injector can be formed only through a line having multiple spirals necessary for absorbing the differences in expansion at its ends and is thus liable to become blocked up; (2) on the other hand, the use of a mixed injector which is designed for alternating use of the two fuels cancels all versatility in the use of the fuels, since the fuel of one of them is exclusive of that of the other.

SUMMARY OF THE INVENTION

An object of the present invention is to overcome each of these disadvantages.

For that purpose, one burner nozzle is used per fuel and the feed pipe of one type is installed next to that of the other. This arrangement has the following consequences: on the one hand, temperatures are involved which are not very different from one pipe to another and slight differential expansions result making connections a simple matter; on the other hand, the possibility is created of being able to burn simultaneously the one fuel and the other between the two extreme limits, namely, gas alone and liquid alone.

The invention resides more particularly in the fact that the spray nozzles and the injectors have separate feed systems, in any proportion and simultaneously operable with their respective combustible fluids, and in that they are arranged in space so as to enable the flow of the combustible fluid to be heated up such that the combustion produces a spaced out giving off of heat thereby insuring the homogenous heating up of the combustible fluid in combination with convection means contributing to the stirring thereof.

BRIEF DESCRIPTION OF THE DRAWING

Other objects and advantages of the present invention will become apparent from the description of a few applications and of an embodiment given by way of an example, with reference to the accompanying drawings in which.

DETAILED DESCRIPTION

Figure 1:
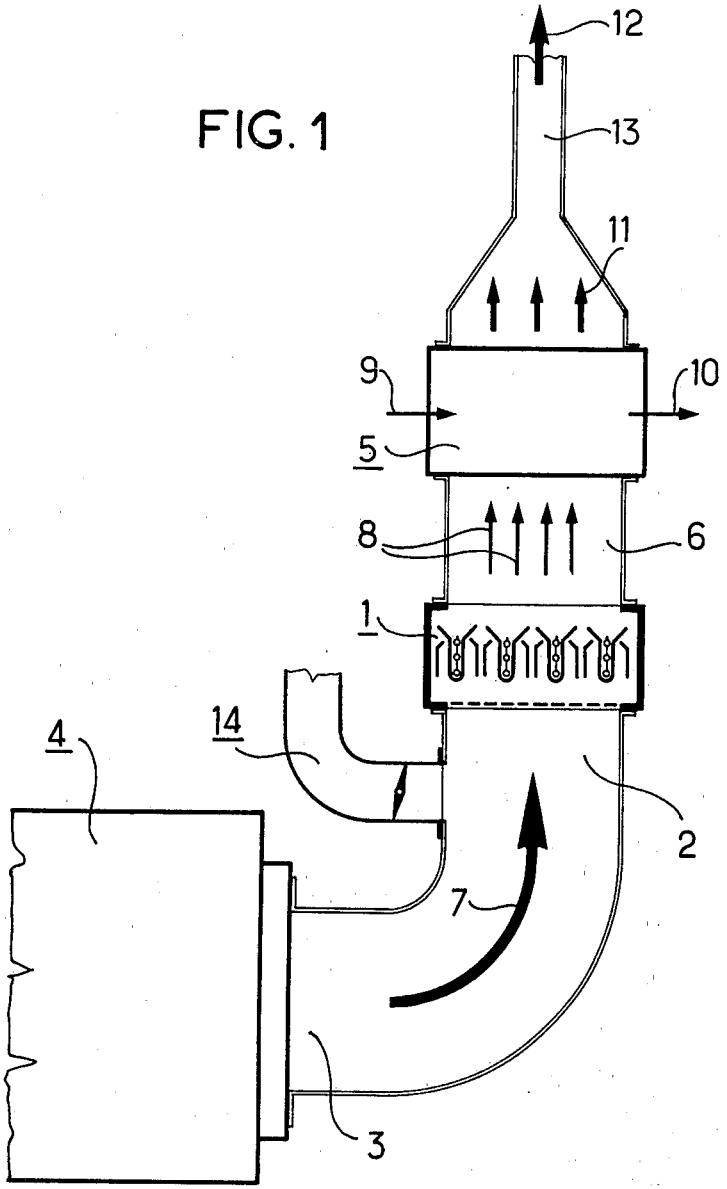
FIG. 1 diagrammatically illustrates a steam generator using a burner according to the invention for heating up the exhaust gases of a gas turbine.

In FIG. 1, a burner 1 is installed in a fire tube 2 connecting the exhaust 3 of a gas turbine 4 to a heat recuperator 5 through the fire tube 6. The after-burner gases of the turbine 4 escape in the direction of the arrow 7, crossing through the burner 1 and taking part in the combustion by a part of the excess of oxygen which they contain and forming a sheet of flames in which they are heated up and, in the direction of the arrows 8, and move to the recuperator 5 which they cross through, transferring a great part of their heat to the recuperation fluid symbolized by the in-going arrow 9 and out-going arrow 10. The gases then emerge at a lower temperature in the direction of the arrows 11 and escape in the direction of the arrow 12, into the atmosphere, through the chimney 13. A derivation pipe 14 makes it possible to avoid the passing of the exhaust gases through the burner 1 or the recuperator 5 when this is necessary.

Figure 2:
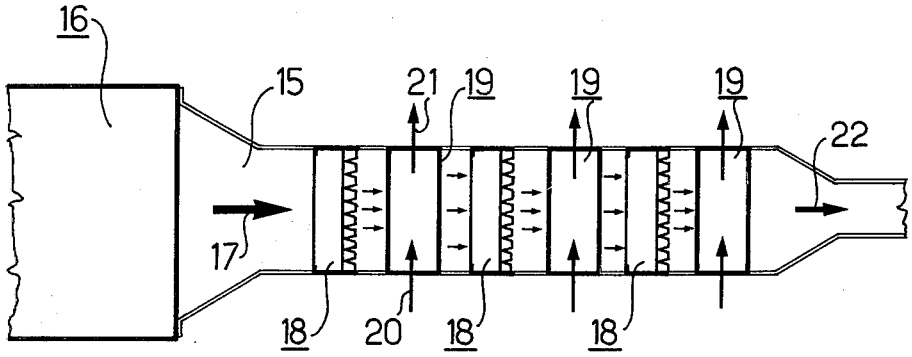
FIG. 2 shows a use of burners arranged in series in a gas exhaust circuit and alternating with heat recuperators.

In FIG. 2, in a fire tube 15 placed at the output of a generator 16 allowing the gases to escape in the direction of the arrow 17, burners 18 of the type which are the object of the invention and recuperators 19 insuring the heating up of the fluid entering in the direction of the arrow 20 and leaving in the direction of the arrow 21 are installed alternately. The cooled exhaust gases emerge from the fire tube 15 in the direction of the arrow 22.

Figure 3A:
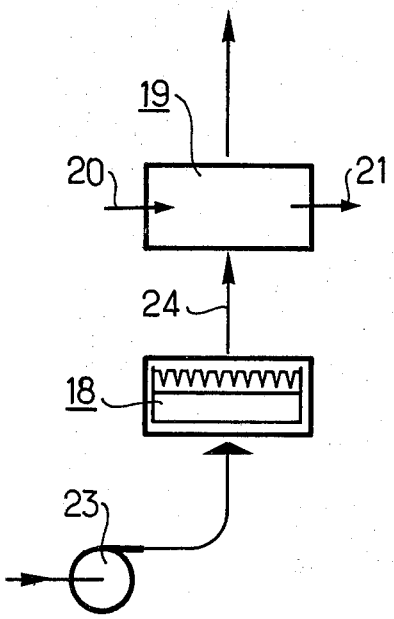
FIGS. 3*a* and 3*b* show the application of a gas reheating burner respectively driven by discharge and by suction.
Figure 3B:
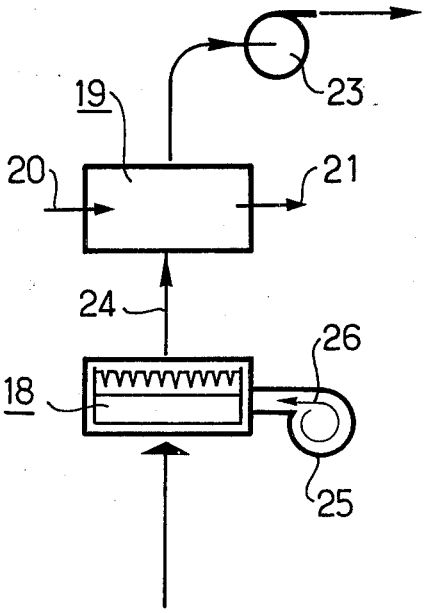

In FIGS. 3*a* and 3*b*, fans 23 are installed respectively at the discharge end and at the suction end to make gases to be heated up pass through a burner 18 to a recuperator 19 along the arrowed path 24.

The recuperator 19 has air intended for the heating up of a premises or even for the heating up of various products passing through it, for example in the direction of the arrows 20 and 21. It is assumed, moreover, that the gas to be heated up in FIG. 3*b*, is inert and the supplying of air necessary for combustion is brought in by the blowing of a fan 25 directly in the burner 18 in the direction 26 parallel to the ramps of the said burner and in the gaps between them.

Figure 4:
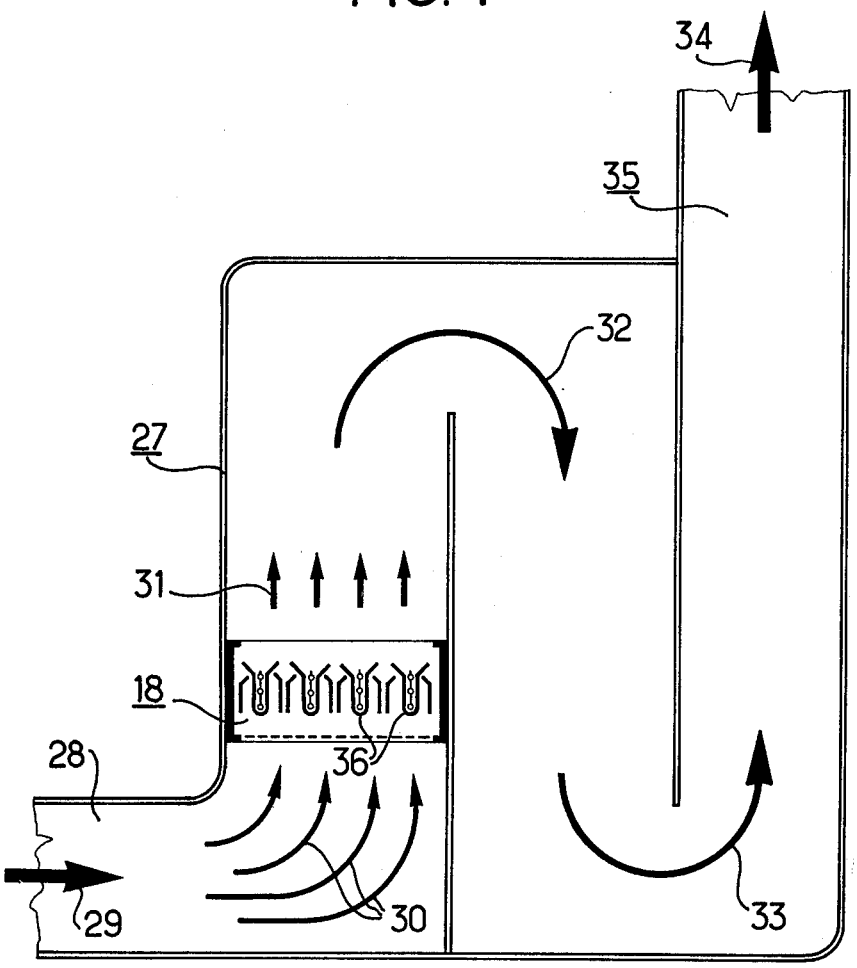
FIG. 4 shows the use of a burner in a combustion chamber for constituting and antipollution device.

In FIG. 4, in a combustion chamber 27 with a double or triple path of travel, a burner 18 is installed, Gaseous effluences charged with combustible products with toxic elements, having a bad smell or inflammable dusts, are brought in by the fire tube 28 along the arrowed path 29 and 30 up to the burner 18, through which they cross. Because of the homogenization and the rising in temperature to which these effluences are subjected when crossing through the burner, their polluting elements result in completely oxidized. They are clean effluences which follow the arrowed output path 31, 32 and 33 and escape from the chimney 35 rid of pollution in the direction of the arrow 34 into the atmosphere.

Figure 5:
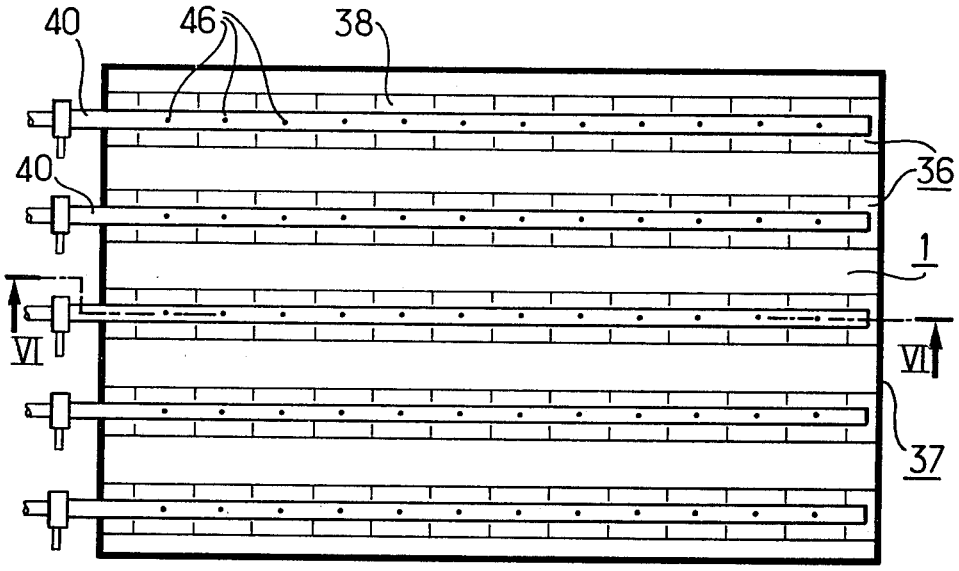
FIGS. 5 and 6 show a burner according to the invention respectively seen from above and and in a part cutaway view through VI—VI in FIG. 5.
Figure 6:
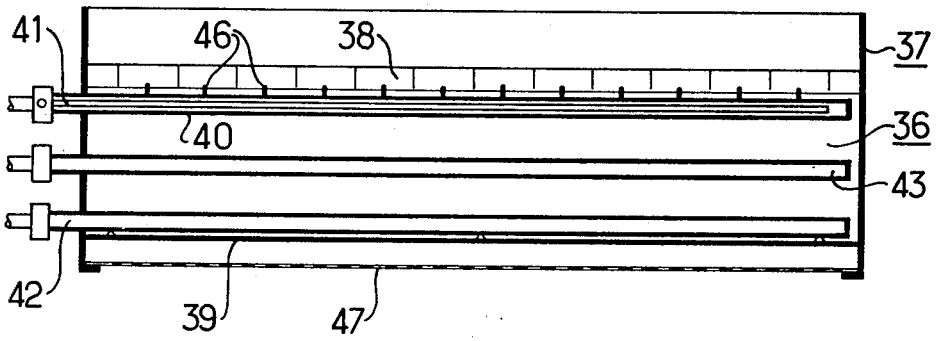

In FIGS. 5 and 6, a series of identical ramps 36 are arranged in the housing 37 of the burner 1 which is installed between the two connecting sections of the fire tube 2 leading the gases from a turbine 4 (FIG. 1), for example, to a heat recuperator 5 which may be of the steam generator type.

The ramps 36 comprise primary deflectors 38 installed on the ramp bodies 39 (FIG. 8) inside each of which are installed the three feed pipes for the fluid combustion nozzles. These pipes include: a pipe 40 for liquid fuel, inside which there is the return line 41, a pipe 42 for liquid fuel spray fluid and a pipe 43 for gaseous fuel. The spray nozzles 44 (FIG. 7) for liquid fuel and the injectors 45 for gaseous fuel are fixed at 46 (FIGS. 5 and 6) on the liquid fuel feed tube 41.

At the lower part of the housing 37 of the burner 1, a grating 47 for the distribution of the gases to be heated up is fixed.

Figure 7:
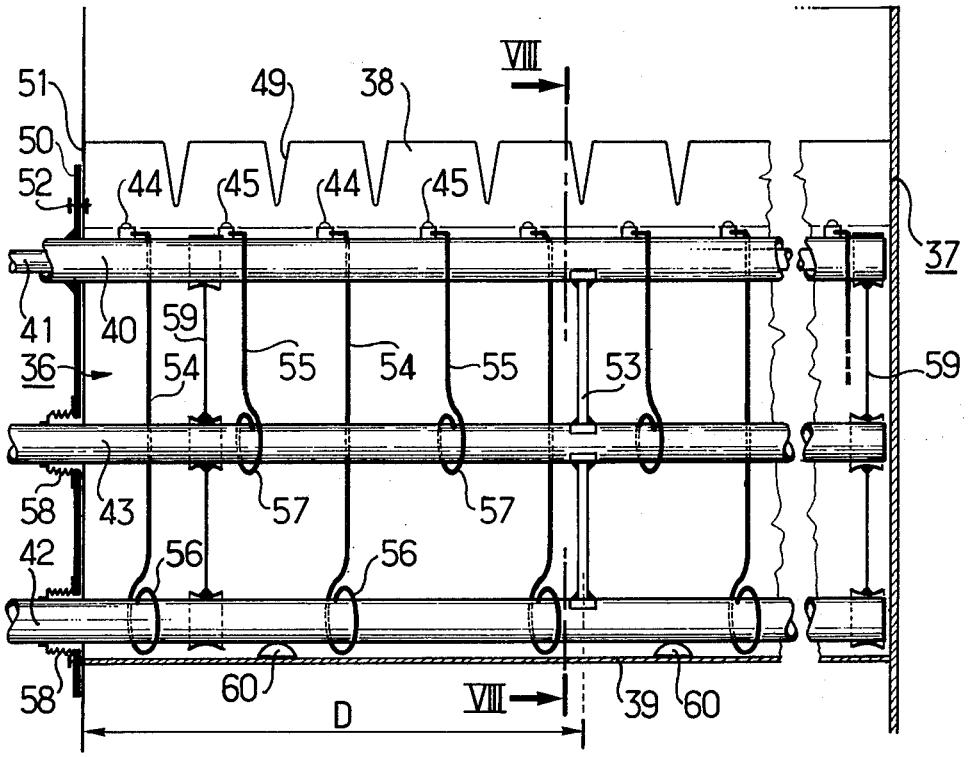
FIG. 7 shows a side view of a burner ramp, the front part of the ramp body having been removed.
Figure 8:
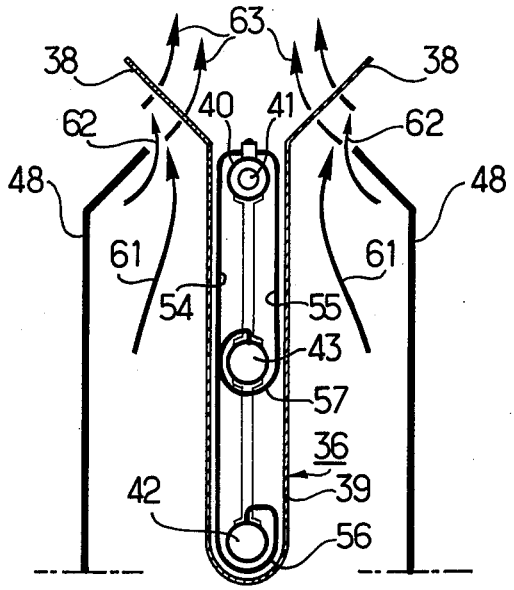
FIG. 8 is a cutaway view through VIII—VIII of the ramp in FIG. 7 and provided with secondary deflectors.

In FIGS. 7 and 8, each burner ramp 36 comprises a ramp body 39 and the three respective distribution pipes 40, 42 and 43 for liquid fuel, for spray fluid and for gaseous fuel respectively.

The deflectors 38 form together an angle in the order of ninety degrees and produce a depression enabling the fixing of the flame, whereas the secondary deflectors 48 take part in the forming of an aerodynamic circuit, directing the combustion gas to be heated up along the upper part of the ramp body 39 and of the primary deflectors 38 in a required quantity for insuring the stability of the flame. This also insures protection of the upper part of the said ramp body 39 and of the said primary deflectors 38 against differences in expansion which the radiation of the sheet of flame could cause. In the primary deflectors 38, slots 49 having a crosssection which is progressive towards the outside insure the letting in of a small part of the combustive gas in the zone under depression whereas the other part is subjected to stirring, in the gap comprised between two neighbouring ramps.

Thus, the fluid to be heated up entering between the ramp body 39 and secondary deflectors 48 in the direction of the arrows 61 is divided into two parts, one in the direction of the arrows 62 licking the outside of the top of the ramp body 39 and of the said deflectors 38, the other in the direction of the arrows 63 crossing through the said deflectors by the slots 49 with which they are provided.

The ramp body 39 forms a partial heat insulation box for the ducts 40, 42 and 43 housed within it, which are brought to temperatures which are not very different from one another but very much different from that of the said ramp body 39 which is directly swept by the exhaust gases to be heated up and often brought to a temperature which is already very high.

It is to avoid deformations due to the differences in expansion that the fluid pipes 40, 42 and 43 are installed in a floating configuration, that is, independent from the ramp body 39.

The pipe 40 for liquid fuel is fixed rigidly to the flange 50 clamped against the wall 51 of the housing 37 by bolts 52.

The pipes 42 and 43 are connected rigidly together and to the pipe 40 by angle irons 53 placed at a distance D from the fixing point of the said pipe 40 to the wall 51 and determined so as to optimize the differential expansions between the said pipes. In this way, the connection lines 54 of the pipe 42 for the spray fluid which is, for example, water vapour, leading to the spray nozzles 44 lines and 55 from the gaseous fuel pipe 43 to the injector 45, comprise only fractions 56, 57 of turns surrounding their corresponding pipes for absorbing the differential expansions.

The danger of stopping up such short lines is thus reduced. Moreover, in order to avoid any stress, on the one hand, the pipes 42 and 43 are connected to the flange 50 by resilient connections 58 while, on the other hand, supports 59, while allowing the pipes 40, 42 and 43 to expand freely, form, moreover, connections enabling the maintaining of their position.

Lastly, the pipes, spray nozzles and injectors assembly fixed to the front face flange 50 may be removed after the nuts have been unscrewed from the bolts 52. The guiding of the position for height is provided by cleats 60 placed at the bottom of the ramp bodies 39.

It must be understood that the description thus given is non-limitative and that many other variations of are possible within the scope of the protection applied for.

What is claimed is:

1. A grid burner for the direct heating of a combustive fluid by the combustion of combustible substances contacting said fluid, said burner comprising a plurality of parallel fluid feed ramps spaced from one another to define gaps for passage of the combustive fluid, each of said ramps comprising spray nozzles for a liquid fuel and a spraying fluid, injectors for a gaseous fuel, respective superimposed independent feed pipes respectively for said liquid fuel, said gaseous fuel and said spraying fluid, a ramp body constituting an insulating housing for said feed pipes, said spray nozzles and injectors for a gaseous fuel being arranged in alignment in alternating equidistant arrangement in said ramps, said nozzles and injectors being coupled to respective of said pipes.

2. A burner for the direct heating of a combustive fluid by the combustion of a combustible substance contacting said fluid, said burner comprising a grating through which passes a fluid to be heated, spray nozzles for a liquid fuel disposed above said grating, injectors for a gas also disposed above said grating, respective independent feed means coupled to said nozzles and said injectors for the effecting of combustion to enable the fluid to be heated up such that the combustion produces a spaced release of heat insuring homogenous heating of the fluid, convection means for promoting the stirring of the combustive fluid, and a plurality of parallel ramps arranged above said grating, said spray nozzles and injectors being arranged in alignment in alternating equidistant arrangement in said ramps, said ramps being spaced from one another to define gaps for passage of the combustive fluid, each ramp including a ramp body, said feed means comprising three feed pipes respectively for gas, liquid and spraying fluid, said ramp body constituting an insulating housing for said three pipes, said pipes being in a superimposed configuration within said ramp body, said liquid fuel pipe comprising a permanent return line for the said liquid for an extra reduction of the heating.

3. A burner for the direct heating of a combustive fluid by the combustion of a combustible substance contacting said fluid, said burner comprising a grating through which passes a fluid to be heated, spray nozzles for a liquid fuel disposed above said grating, injectors for a gas also disposed above said grating, respective independent feed means coupled to said nozzles and said injectors for the effecting of combustion to enable the fluid to be heated up such that the combustion produces a spaced release of heat insuring homogenous heating of the fluid, convection means for promoting the stirring of the combustive fluid, and a plurality of parallel ramps arranged above said grating, said spray nozzles and injectors being arranged in alignment in alternating equidistant arrangement in said ramps, said ramps being spaced from one another to define gaps for passage of the combustive fluid, each ramp including a ramp body, said feed means comprising three feed pipes respectively for gas, liquid and spraying fluid, said ramp body constituting an inusulating housing for said three pipes, said pipes being in a superimposed configuration within said ramp body, said liquid fuel pipe comprising a permanent return line for the said liquid for an extra reduction of the heating, and means supporting the three pipes in each ramp body in floating relation in said body, one of said pipes being secured at one end thereof in said burner, the other two pipes being secured to the first pipe at a distance from the secured end thereof for compensation of their differential expansion.

4. A burner as claimed in claim 3 wherein the spray nozzles and the injectors in each ramp are fixed to the liquid fuel pipe, the latter being uppermost in said ramp body adjacent an open upper end thereof and means for feeding said spray nozzles and injectors respectively with spray fluid and gas including conduits connecting said nozzles and injectors with the respective spray fluid and gas pipes and including around each pipe a winding smaller than one turn.

5. A burner as claimed in claim 4 wherein said spray nozzles and injectors are open into said liquid fuel pipe to introduce liquid fuel by injection into the spray fluid and gas being discharged respectively from the spray nozzles and injectors.

6. A burner for the direct heating of a combustive fluid by the combustion of a combustible substance contacting said fluid, said burner comprising a grating through which passes a fluid to be heated, spray nozzles for a liquid fuel disposed above said grating, injectors for a gas also disposed above said grating, respective independent feed means coupled to said nozzles and said injectors for the effecting of combustion to enable the fluid to be heated up such that the combustion produces a spaced release of heat insuring homogenous heating of the fluid, convection means for promoting the stirring of the combustive fluid, and a plurality of parallel ramps arranged above said grating, said spray nozzles and injectors being arranged in alignment in alternating equidistant arrangement in said ramps, said ramps being spaced from one another to define gaps for passage of the combustive fluid, each ramp including a ramp body, said feed means comprising three feed pipes respectively for gas, liquid and spraying fluid, said ramp body constituting an insulating housing for said three pipes, said pipes being in a superimposed configuration within said ramp body, said liquid fuel pipe comprising a permanent return line for the said liquid for an extra reduction of the heating, each ramp body having an upper open end and including angular upwardly extending deflectors being provided with spaced slots having a cross-section increasing upwardly.

7. A burner as claimed in claim 6 comprising secondary deflectors adjacent the first said deflector to define a gap between two adjacent ramp bodies forming an aerodynamic circuit for the combustive fluid.

8. A burner as claimed in claim 7 further comprising fan means for introducing air into the gaps between adjacent ramp bodies in a direction parallel to the pipes.

* * * * *